US011035632B1

(12) United States Patent
Sugg

(10) Patent No.: US 11,035,632 B1
(45) Date of Patent: Jun. 15, 2021

(54) CAM PATH APPARATUS AND USES THEREOF

(71) Applicant: Edward Arthur Sugg, South Riding, VA (US)

(72) Inventor: Edward Arthur Sugg, South Riding, VA (US)

( * ) Notice: Subject to any disclaimer, the term of this patent is extended or adjusted under 35 U.S.C. 154(b) by 0 days.

(21) Appl. No.: 16/032,008

(22) Filed: Jul. 10, 2018

Related U.S. Application Data

(63) Continuation-in-part of application No. 15/732,225, filed on Oct. 6, 2017, now abandoned, which is a continuation-in-part of application No. 15/732,671, filed on Dec. 12, 2017, now Pat. No. 10,571,213, which is a continuation-in-part of application No. 15/248,525, filed on Aug. 26, 2016, now Pat. No. 10,151,544, and a continuation-in-part of application No. 15/732,225, application No. 16/032,008, which is a continuation-in-part of application No. 15/932,484, filed on Mar. 6, 2018, which is a continuation-in-part of application No. 15/732,671, and a continuation-in-part of application No. 15/732,225, and a continuation-in-part of application No. 15/678,831, filed on Aug. 16, 2017, now Pat. No. 10,101,103, and a continuation-in-part of application No. 15/248,525.

(60) Provisional application No. 62/530,297, filed on Jul. 10, 2017, provisional application No. 62/573,855, filed on Oct. 18, 2017, provisional application No. 62/662,684, filed on Apr. 25, 2018, provisional application No. 62/405,195, filed on Oct. 6, 2016, (Continued)

(51) Int. Cl.
*F41A 3/26* (2006.01)

(52) U.S. Cl.
CPC ..... *F41A 3/26* (2013.01)

(58) Field of Classification Search
CPC ..... F41A 3/26
See application file for complete search history.

(56) References Cited

U.S. PATENT DOCUMENTS 2,951,424 A * 9/1960 Stoner ..... F41A 3/16 89/179
3,667,147 A * 6/1972 Goldin ..... F41A 9/45 42/15

(Continued)

OTHER PUBLICATIONS

"Surefire Optimized Bolt Carrier Assembly—Guns and Ammo", http://www.gunsandammo.com/editorial/surefire-optimized-bolt-carrier-assembly/247565# (Year: 2018).*

(Continued)

*Primary Examiner* — Joshua T Semick
(74) *Attorney, Agent, or Firm* — Arent Fox LLP

(57) ABSTRACT

A bolt carrier for a firearm having a first end configured to slidably engage with a bolt along a first axis, the bolt carrier comprising, a cam pin, a cam slot for movably constraining the cam pin, and a bolt operatively connected to a cam pin, wherein cam pin and cam slot at least partially constrain the rotational and linear movement of the bolt with relation to the bolt carrier. The cam slot further includes a first portion for constraining the linear motion of the cam pin and the bolt and a second portion for controlling rotational movement of the bolt while guiding the cam pin along the cam slot. The cam slot further includes a third portion a third portion for controlling the linear motion of the bolt.

9 Claims, 4 Drawing Sheets

Related U.S. Application Data provisional application No. 62/411,538, filed on Oct. 22, 2016, provisional application No. 62/432,739, filed on Dec. 12, 2016, provisional application No. 62/366,110, filed on Jul. 24, 2016, provisional application No. 62/342,460, filed on May 27, 2016, provisional application No. 62/326,762, filed on Apr. 24, 2016, provisional application No. 62/325,991, filed on Apr. 21, 2016, provisional application No. 62/320,432, filed on Apr. 8, 2016, provisional application No. 62/311,874, filed on Mar. 22, 2016, provisional application No. 62/310,486, filed on Mar. 18, 2016, provisional application No. 62/279,887, filed on Jan. 18, 2016, provisional application No. 62/245,834, filed on Oct. 23, 2015, provisional application No. 62/210,278, filed on Aug. 26, 2015, provisional application No. 62/619,871, filed on Jan. 21, 2018, provisional application No. 62/472,574, filed on Mar. 17, 2017, provisional application No. 62/467,812, filed on Mar. 6, 2017.

(56) References Cited

U.S. PATENT DOCUMENTS

| | | | | | |
|---|---|---|---|---|---|
| 3,713,363 | A * | 1/1973 | Hurlemann | F41A 5/18 | 89/185 |
| 3,996,684 | A * | 12/1976 | Bauman | F41A 3/26 | 42/16 |
| 4,102,241 | A * | 7/1978 | Magardo | F41A 9/27 | 89/155 |
| 4,191,089 | A * | 3/1980 | Zedrosser | F41A 3/26 | 89/181 |
| 4,416,186 | A * | 11/1983 | Sullivan | F41A 3/26 | 89/198 |
| 4,527,459 | A * | 7/1985 | Childers | F41A 9/47 | 89/161 |
| 4,697,496 | A * | 10/1987 | Goldin | F41A 9/35 | 89/1.41 |
| 6,176,169 | B1 * | 1/2001 | Rostocil | B64D 7/00 | 42/25 |
| 8,234,808 | B2 * | 8/2012 | Lewis | F41A 3/26 | 42/71.01 |
| 9,038,525 | B2 * | 5/2015 | Sullivan | F41A 13/12 | 89/193 |
| 9,885,529 | B2 * | 2/2018 | Lewis | F41A 19/13 | |
| 10,488,128 | B2 * | 11/2019 | Leitner-Wise | F41A 3/16 | |
| 2017/0321978 | A1 * | 11/2017 | Brannan | F41A 5/28 | |

OTHER PUBLICATIONS

"Bolt Rings Damaged?", https://www.ar15.eom/forums/ar-15/Bolt_rings_damaged_/118-652490/, entry #4 from AR-4C, pp. 3-6 (Year: 2014).*

* cited by examiner

CAM PATH APPARATUS AND USES THEREOF

This application claims priority to U.S. Provisional Application No. 62/530,297, which was filed on Jul. 10, 2017, U.S. Provisional Application No. 62/573,855, which was filed on Oct. 18, 2017, and U.S. Provisional Application No. 62/662,684, which was filed on Apr. 25, 2018. This application is a continuation-in-part of U.S. application Ser. No. 15/732,225, which was filed on Oct. 6, 2017, which in turn claims priority to U.S. Provisional Application No. 62/405,195 filed Oct. 6, 2016, and U.S. Provisional Patent Application No. 62/411,538 filed Oct. 22, 2016. This application is also a continuation-in-part of U.S. application Ser. No. 15/732,671, which was filed on Dec. 12, 2017, which in turn claims priority to U.S. Provisional Patent Application 62/530,297, which was filed on Jul. 10, 2017, U.S. Provisional Patent Application 62/432,739 which was filed on Dec. 12, 2016, U.S. Provisional Patent Application 62/366,110, which was filed on Jul. 24, 2016, U.S. Provisional Patent Application 62/342,460, which was filed on May 27, 2016, U.S. Provisional Application No. 62/326,762, which was filed on Apr. 24, 2016, U.S. Provisional Patent Application No. 62/325,991, which was filed on Apr. 21, 2016, U.S. Provisional Patent Application No. 62/320,432, which was filed on Apr. 8, 2016, U.S. Provisional Patent Application No. 62/311,874, which was filed on Mar. 22, 2016, U.S. Provisional Patent Application No. 62/310,486, which was filed on Mar. 18, 2016, U.S. Provisional Patent Application No. 62/279,887, which was filed on Jan. 18, 2016, U.S. Provisional Patent Application No. 62/245,834, which was filed on Oct. 23, 2015, and U.S. Provisional Patent Application No. 62/210,278, which was filed on Aug. 26, 2015; U.S. patent application Ser. No. 15/732,671 is also a continuation-in-part of U.S. patent application Ser. No. 15/248,525, which was filed on Aug. 26, 2016, and U.S. patent application Ser. No. 15/732,225, which was filed on Oct. 6, 2017. This application is also a continuation-in-part of U.S. application Ser. No. 15/932,484 filed on Mar. 6, 2018, which in turn claims priority to U.S. Provisional Patent Application No. 62/619,871, which was filed on Jan. 21, 2018, U.S. Provisional Patent Application No. 62/573,855, which was filed on Oct. 18, 2017, U.S. Provisional Patent Application No. 62/530,297, which was filed on Jul. 10, 2017, U.S. Provisional Patent Application 62/472,574, which was filed on Mar. 17, 2017, U.S. Provisional Patent Application 62/467,812, which was filed on Mar. 6, 2017, U.S. Provisional Patent Application No. 62/411,538, which was filed Oct. 22, 2016, and U.S. Provisional Patent Application No. 62/405,195, which was filed Oct. 6, 2016; U.S. patent application Ser. No. 15/932,484 also claims priority to U.S. patent application Ser. No. 15/732,671, which was filed on Dec. 12, 2017, U.S. patent application Ser. No. 15/732,225, which was filed on Oct. 6, 2017, U.S. patent application Ser. No. 15/678,831, which was filed on Aug. 16, 2017, and U.S. patent application Ser. No. 15/248,525, which was filed on Aug. 26, 2016. The contents of each of the foregoing are incorporated herein by reference in their entirety.

TECHNICAL FIELD

Aspects of the present disclosure relate to improvements to the operational components of semiautomatic, select fire, and/or fully automatic firearms and weapons, including various center fire caliber and other weapons or firearms, whether commercial or defense oriented. More specifically, aspects of the present disclosure relate to improvements to the operational components that may be applicable to the M16, AR14, M4, and/or AR10 families of weapons. Improvements may include any one or a combination of reliability and/or performance enhancements to the Bolt Carrier, the Bolt Catch, Bolt, Cam Pin, Cam Path, Action Spring, Selector and/or Buffer.

BACKGROUND

There exists in the current state of firearms and arms the need to reduce stress on various components, as well as improve the reliability and efficiency of firearms, weapons, and small arms.

Current and semi and full automatic firearms generally use rotating bolt mechanisms to lock the bolt into battery and unlock the bolt from battery to permit firing. This rotating method permits the bolt to "seal" the cartridge into a chamber of a barrel for firing, and to extract the fired casing from the chamber after firing.

Unduly high rotation of the bolt into and out of battery creates undesirable stresses on critical components, such as lugs and the bolt itself. These stresses can lead to harsh operation, shortened component life, and breakage at critical times. The stresses can also cause severe torque, which impedes accurate fire and smooth operation of the firearm or weapon. These effects cause the sight picture to be disturbed excessively during firing and make the shooter try to overcome unnecessary and avoidable movement of the firearm or weapon.

Current rotation rates range among firearms, with common examples being the AK47 and variants, and the M16/AR15/AR10 and variants. Even though the AK47 moves rearward approximately 0.600" before the bolt appears to be unlocked, close examination reveals that the actual movement of the bolt uses only part of this space to complete its approximately 45 degree rotation. Depending on variances, this space is typically about 0.110" to about 0.140" of actual rotational movement, with the balance being taken by "locked dwell" and "unlocked dwell." The locked and unlocked dwell are areas designed into the firearm to provide fore and aft movement without additional rotational movement. This approach yields a rotational movement of about 315 to about 400 degrees of rotation per inch of rearward travel on the AK series of weapons. The M16/AR15 et al series of weapons uses approximately 0.213" of rearward movement—using the Table (of Rotational Cam Pin Movement—Cam Path) in the M16 Technical Data Package (TDP) to rotate approximately 22.5 degrees, which creates rotational movement of about 105.63 degrees per inch. This action covers the movement between the "locked" position of the Bolt-in Battery, or from the "locked dwell" to the "unlocked" position of the Bolt, or from the "unlocked dwell." The "dwell" spaces are areas that firearms designers include to allow movement without rotation as described above.

SUMMARY

Aspects of the present disclosure relate to a rotating bolt firearm or weapon having a first end configured to slidably engage with a bolt along a first axis, the bolt carrier comprising, a cam pin, a cam slot for movably constraining the cam pin, and a bolt operatively connected to a cam pin, wherein the cam pin and cam slot at least partially constrain the rotational and linear movement of the bolt with relation to the bolt carrier. The cam slot may further include a first portion for constraining the linear motion of the cam pin and the bolt and a second portion for controlling rotational movement of the bolt while guiding the cam pin along the cam slot. The cam slot may further include a third portion for controlling the linear motion of the bolt.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Bolt Carrier/Cam Path

The M16/AR15 Family of Weapons ("FOW") uses a sliding assembly to hold the Bolt, known as the Bolt Carrier. This assembly controls the movement and rotation (locking and unlocking) of the Bolt during firing operations. While the disclosures herein are repeated for emphasis and clarity from previous applications to specifically address this FOW, they can be broadly applied to any weapon or arm that uses a sliding assembly within a receiver to control the locking and unlocking actions of a rotating Bolt.

The current TDP (Technical Data Package, or basis for the extant M16/M4/AR15/AR10 Family of Weapons) has a Cam Path that uses an initial "dwell" of about 0.070" coupled with an "(un)locking" space wherein the Bolt "locks" into battery or "unlocks" from battery covering about 0.213", coupled with an ending "dwell" when the Bolt is fully unlocked over about 0.042". This feature causes the Bolt to unlock sooner than is optimal, and causes much greater than necessary or optimal stress upon the Bolt upon locking or unlocking. It also causes difficulty in the gun successfully loading and "locking" the next round into the chamber. The total "space" used for the cycling of the Bolt is about 0.325". The space used for locking/unlocking is thus about 65.54% of the total, and the space used for the "locked dwell" is about 21.54% with the "unlocked dwell" being about 12.92% of the total.

Figure 1:
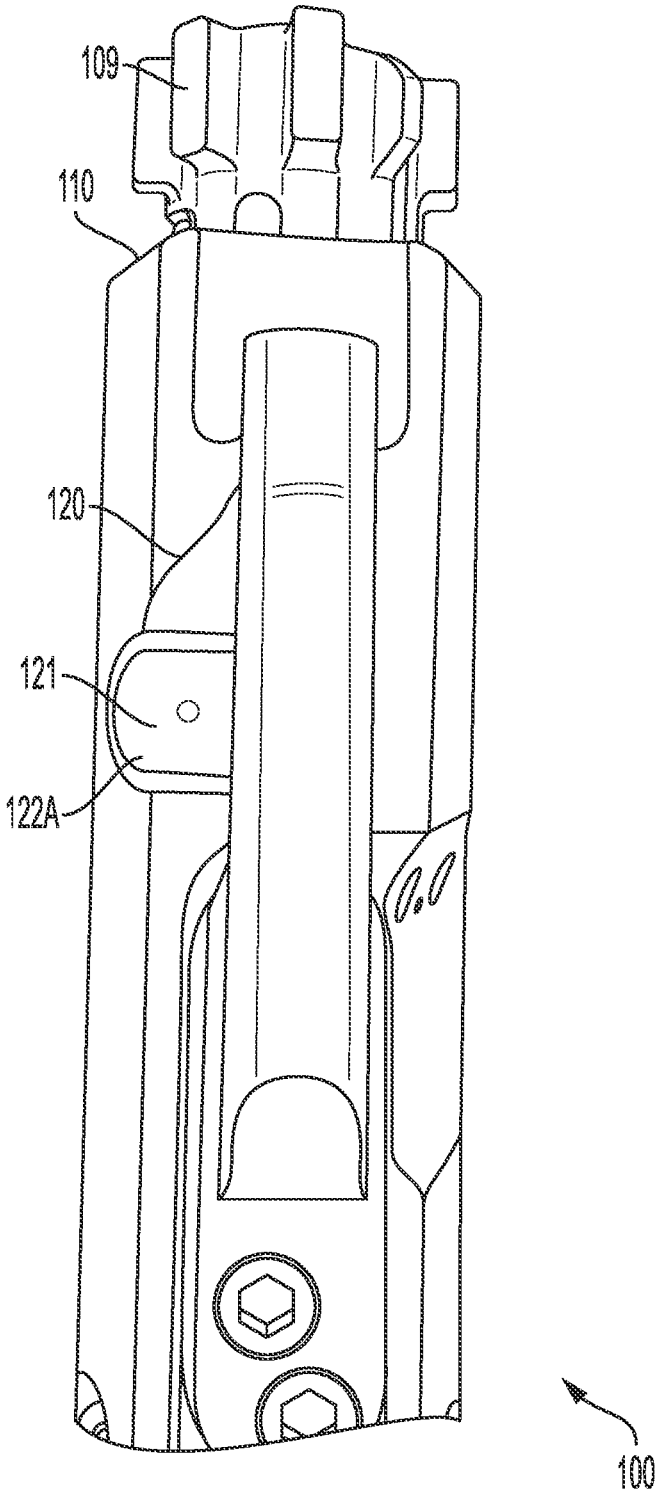
FIG. 1 shows a top view of a bolt carrier in accordance with one aspect of the disclosure.
Figure 2:
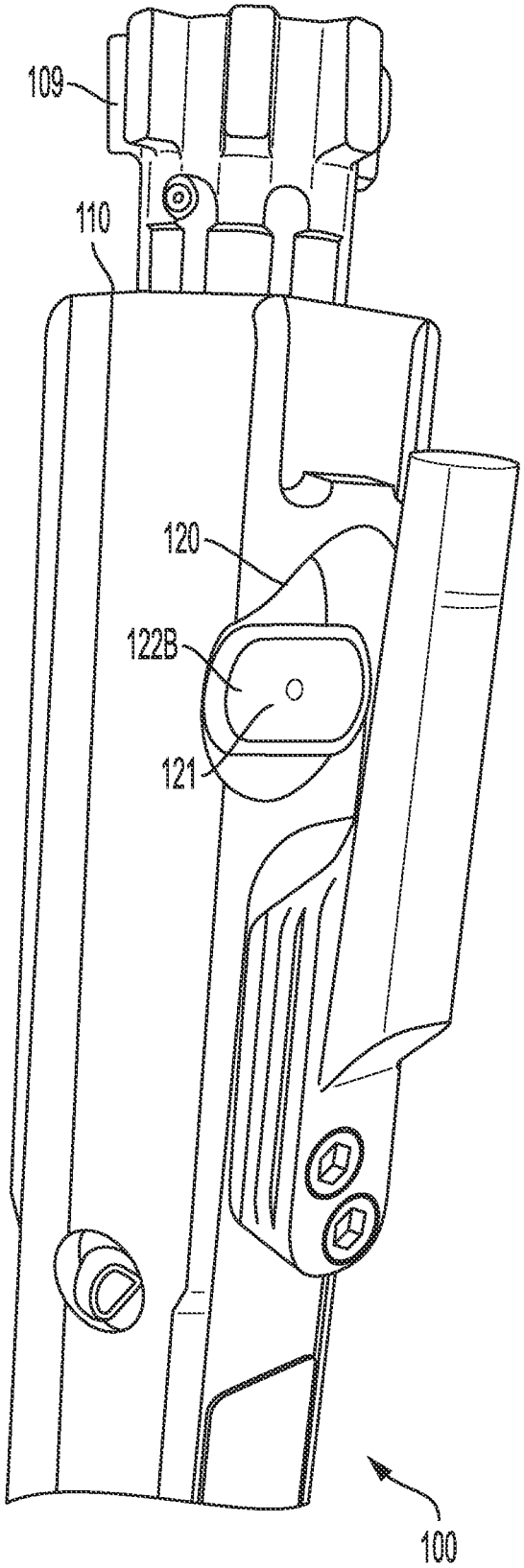
FIG. 2 shows a top—perspective view of the bolt carrier of FIG. 1 in a second mode of operation.
Figure 3:
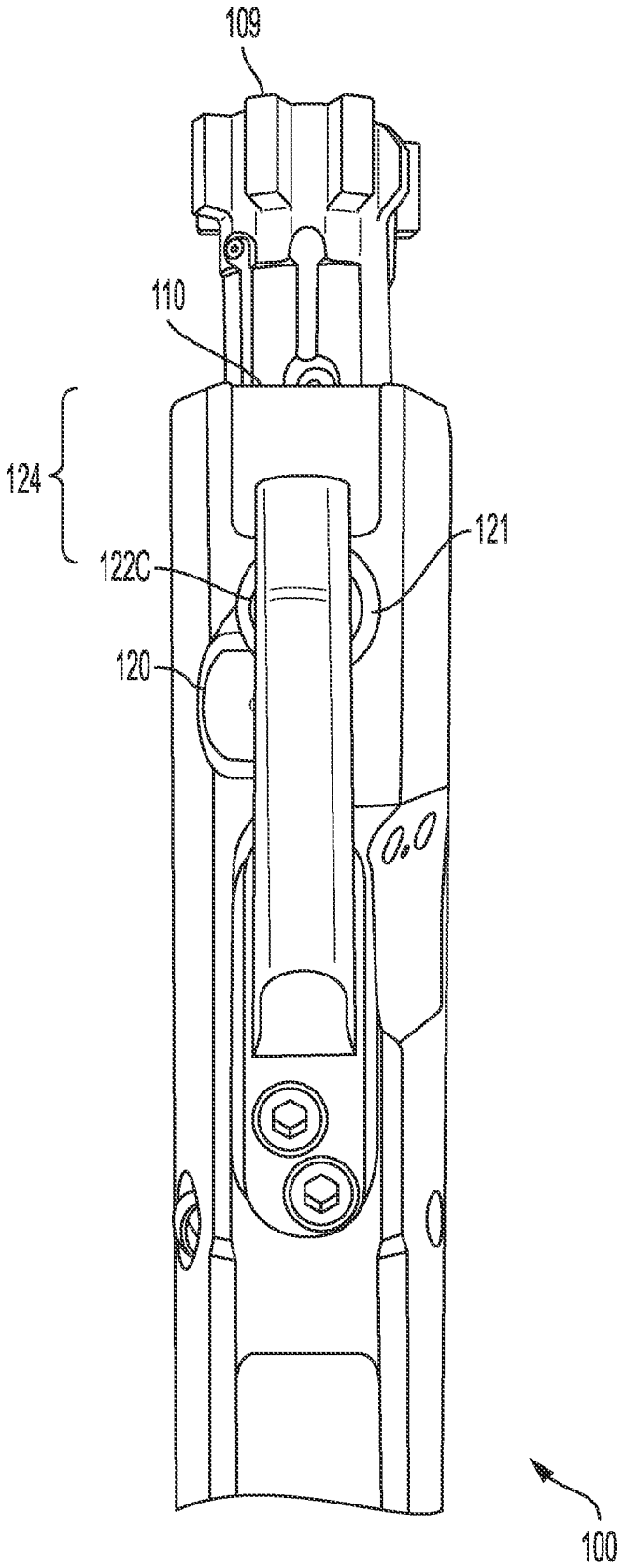
FIG. 3 shows a top view of the bolt carrier of FIGS. 1 and 2 in a third mode of operation in accordance with one aspect of the disclosure.

FIGS. 1-3 show various positions of a cam pin 121 and a bolt 109 with relation to a bolt carrier 100 for an example firearm. The interaction between the cam pin 121 and cam path 120 may constrain the linear movement of the bolt 109 along a first axis 101 (FIG. 3), and the rotation of the bolt 109 about axis 101 with relation to the bolt carrier 100 during operation of the firearm, for example. FIG. 1 shows a view of the cam pin 121 in the locked position 122A within a first portion of the cam path 120. In this position, the bolt 109 is fully in the battery, which allows the firearm to be safely fired.

FIG. 2 shows a view of one example of the cam 121 in a mid-camming position 122B at a second portion of the cam path between locked position 122A (FIG. 1) and unlocked dwell position 122C (FIG. 3). In the second portion of the cam path shown in FIG. 2, the cam pin rotates as it travels from the locked position 122A (FIG. 1) to the unlocked dwell position 122C (FIG. 3).

As shown in FIG. 3, as the bolt 109 moves along the first axis 101 (FIG. 3), a third portion of the cam path guides the cam-pin to the unlocked dwell position 122C, which may be interchangeably referred to as the second portion. As the cam pin travels between the locked position 122A (FIG. 1) and the unlocked dwell position 122C (FIG. 3), the bolt 109, which is operatively connected to the cam-pin, may rotate approximately 22.5 degrees. As shown in FIG. 3, distance 124 may represent a distance from the center of the first portion of the cam path to the front surface of the bolt carrier 110 along a fourth axis that may be parallel with or co-axial with a third axis 123C. Thus, when the cam pin is in the first position, distance 124 may also represent the distance from the center of the cam pin 121 to the front surface of the bolt carrier 110.

Previous attempts to "improve" the Cam Path have involved extension of the "locked" dwell area. This approach leads to shortening of the unlocking and locking space, and also causes problems with the gun failing to operate reliably in full auto fire, which can result from a "dead hammer" where the hammer strike against the firing pin fails to fire a round. This result is due to the fact that, among other things, the Bolt movement with a poorly changed or modified Cam Path precludes the Firing Pin from actually contacting the "primer" of the Cartridge, and thus the round or Cartridge cannot fire, resulting in a failure to fire.

It is noted that the figures provided may be taken as absolute dimensions or as percentage of space available for control of rotational movement of the bolt within a sliding device or a sliding carrier within a receiver. Nothing described herein should be construed to limit the applicability of this concept, as it is useful across a wide potential range of applications. In any case, implementation of various features described herein will serve to reduce the forces applied during locking and unlocking, and may also be used to delay the "unlock" of the bolt from battery. This delay eases extraction as the empty case is depressurized, and it also reduces fouling that may blow back under pressure into the action of the weapon. This result will provide adequate safety and operational margins at the "locked dwell" and "unlocked dwell," while providing more space for rotational travel of the Bolt and hence smoother and more reliable and durable operation of the Bolt.

Ideally the space for rotational movement of the Bolt will be more than about 74-78% or more of the available space provided or otherwise available within what is termed as the "Cam Path," or the total space—especially towards front to rear, generally parallel with the Bore—that is available for movement or travel. This approach applies, as do the other aspects, to both the M16/AR15 or Stoner FOW, as well as other weapons or arms using similar design aspects of the Bolt rotation moved or controlled within a receiver by a sliding device such as a Bolt Carrier. The increase in rotational space to about 74-78% or more of the available space is due to the near or complete reduction in the Unlocked Dwell and using that space for additional rotational movement.

This space may be further extended beyond nominal 0.325" length per TDP from 0.003"-0.005," preferably 0.005"-0.010", even more preferably 0.010"-0.020", and most preferably 0.020"-0.050" or more. With structural changes described earlier, this space may be extended beyond this to as much as 0.050"-0.080", or even 0.080"-0.120" or even 0.120"-0.200" or more. This increase in space involves decreasing the space in the TDP measurement from the center of the Cam Pin at "full unlock" to the front of the Bolt Carrier to less than the TDP dimension by the aforementioned changed figures.

The "reference point" of the center of the Cam Pin from the front of the bolt carrier may be reduced to less than 0.640" per current TDP, to the greatest extent possible that the Extractor Pin is still partially covered by the Bolt Cavity of the Carrier—this is in order to prevent "walkout" or loss during firing operation of the Extractor Pin. This space should be 0.635"-0.6395", or preferably 0.630"-0.635", even more preferably 0.620"-0.630", and most preferably 0.590"-0.620." Ideally the change will be in the range of about 0.001-0.033" additional movement or linear space to the extant approximately 0.325" space with standard M16 and M4 Cam Pin sizes. Different Cam Pin sizes as used, for example in the AR10 and variants, should be taken into consideration and adjusted accordingly. This is true here as well as other aspects described herein to Cam Path improvements.

With changes described above, the space may be reduced significantly and reflect the changes covered in the prior paragraph. In any case, it is desirable for the Extractor Pin ("Pin") to remain at least somewhat covered by the Carrier recess (Bolt Cavity) to prevent walkout of the Pin and possible jamming or loss of the Extractor. As described previously, the Pin may be moved back on the Bolt via re-engineering. Also, the Pin may be expanded in size to facilitate movement of the Bolt in a covered state. Further, the lessening of the "angle" of the Cam Path is disclosed, and repeated here for emphasis. If the Bore is 0 degrees, and perpendicular to the Bore is 90 degrees, Cam Path angles of less than 45 degrees are repeated here for emphasis. Optimally, the Cam Path will be 42-44.9 degrees, more optimally 39-42 degrees, even more optimally 36-39 degrees, and most optimally 30-36 degrees or less. The smaller or less steep the angle, the less violent unlocking will be, and the less the resistance of chambering cartridges and locking of the Bolt Lugs into Battery.

The Bolt Carrier may be further improved by the use of a "compound" Cam Path. This Compound Cam Path ("Path") ensures smoother and more reliable operation by turning more slowly when the gun has just been fired and the cartridge is at maximum pressure. As the pressure abates and cartridge obduration (swelling of brass under pressure) lessens, the Path provides for more rapid rotation of the Bolt. This effect pushes out the "unlock" of the Bolt to the maximum extent possible, while easing extraction of the fired case, which lessens the possibility of a stuck case and also lessens the possibility of a torn Extractor or ripped Case. This occurs where the Rim (which the Extractor "grabs") is ripped out under force, but where the Case is held in place due to obduration (or swelling under gas pressure), which may cause a break to the Case or Extractor. Any of these results may be catastrophic in normal conditions, but deadly in duty or defensive use.

The rotation or turn rate (distance covered per degree of rotation) in the Compound Path varies, but is approximately 1-10% slower versus TDP Cam Path, and preferably 10-25% slower, more preferably 25-50% slower, even more preferably 50-100% slower, and most preferably 100-250% or more slower as compared to the TDP Cam Path in "turn rate" or travel of the Bolt when locking/unlocking. This travel occurs between the start point ("Locked Dwell") and end point ("Unlocked Dwell") of the firing cycle of the Bolt movement within the Cam Path and Bolt Carrier. The Cam Path may be extremely critical to the operation of the gun, as it controls the movement of the Bolt. While generally the rotational turn rate will decrease or be slower versus TDP, there are advantages to increasing the turn rate at the very start of rotational movement. The turn rate in the first degree of rotational movement may be increased, and thus the space used which is currently 0.041" may be reduced to less than 0.041" of linear movement for the first degree, which is from 22.5 degrees fully locked to 21.5 degrees. This space can be used elsewhere within the Cam Path to promote greater efficiency and smoothness. Likewise the second degree of rotational movement—from 21.5 degrees to 20.5 degrees can use the current 0.014" of space or it can have the space increased or decreased as desired—thus the turn rate may increase or decrease. This may be used with the extant Locked Dwell of 0.070", or it may be used with Locked Dwell which is greater than or less than 0.070" in space.

The Unlocked Dwell may be almost entirely or altogether eliminated due to the fact that actual unlocking takes place prior to the 0 degree point, as previously disclosed in the present inventor's prior patent applications. Thus, the Unlocked Dwell can be reduced to less than 0.002," or may be eliminated entirely.

Figure 4:
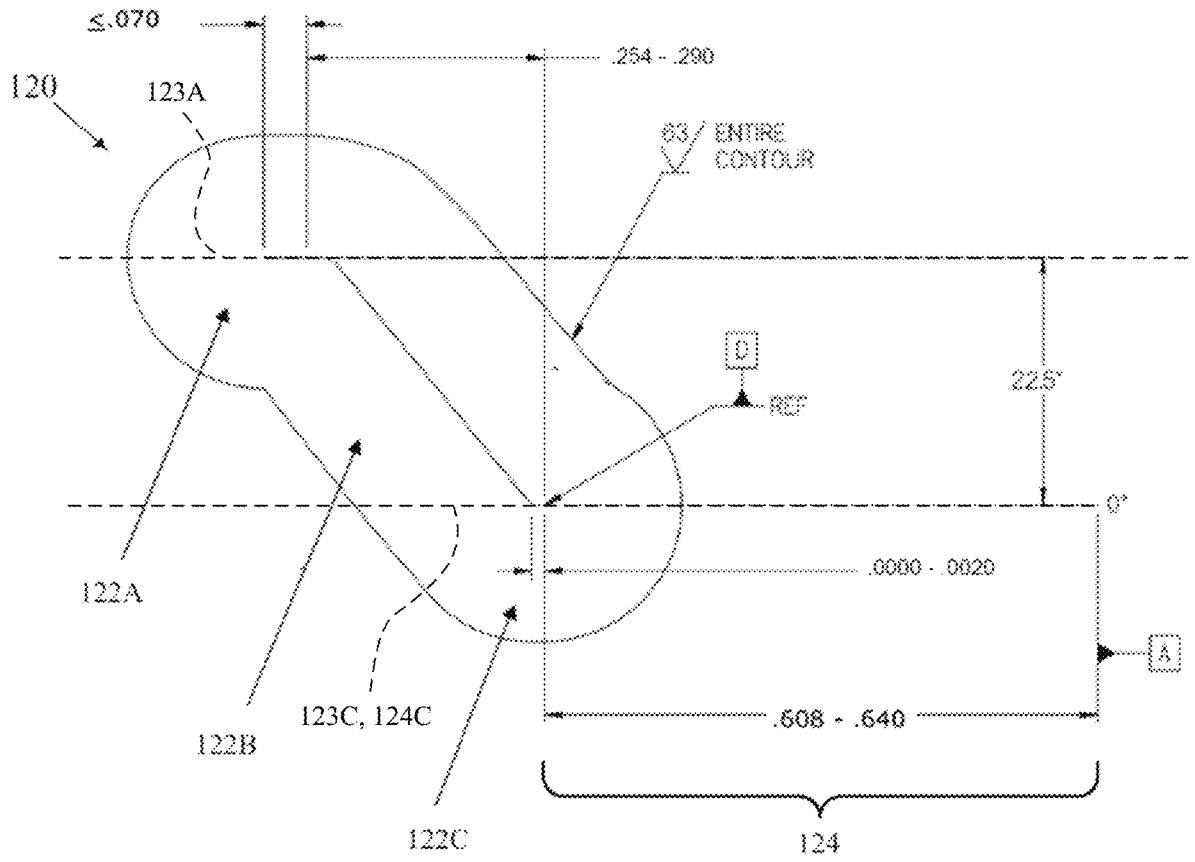
FIG. 4 shows a plan view of a cam path in accordance with one aspect of the disclosure.

As shown in FIG. 4, in a first portion 122A of a cam path, the travel along a second axis 123A that may be substantially parallel to the first axis 101 (FIG. 3) during the locked dwell section in the first portion of the cam path may be maintained at 0.070" or may be decreased to less than 0.070". The changes applied to the initial rotational movement may be applied to standard or increased or decreased locked dwell areas. Further, in the second portion of the cam path 122C, a distance of travel along a third axis 123C that is substantially parallel to the first axis and the second axis may be decreased to between 0.0000" and about 0.0015".

The travel of the Cam Path may be extended forward by 0.001"-0.010," or preferably 0.010"-0.020," or most preferably 0.020"-0.034", while still ensuring proper operation of the Bolt (in the M4/M16 per TDP, adjusted accordingly for AR10 and other size platforms) and still keeping the Extractor Pin covered (to prevent walkout or falling out while firing) by the Bolt Carrier. For reference, the Travel enhancement refers to extension beyond the normal end that is centered on 0.640" or so distance from the font of the Carrier (of the M16/M4 and adjusted accordingly on the AR10, for example). This permits the current approximate 0.640" distance as shown from the Carrier front to be reduced to about 0.605-0.639".

Additionally, the Bolt Carrier body and rails may be extended beyond or pushed out from normal TDP diameter (0.9935"-0.9945") given the 1.000"+/−0.006" Receiver diameter. This advantage is repeated here with an emphasis on smoother, more reliable travel of the Bolt Carrier while firing. This approach reduces oscillation and stress, while increasing consistency of movement and cycling, which in turn may enhance accuracy by ensuring consistent feeding and Bolt lockup when going into Battery.

In addition, the decrease in the turn rate, or rotational rate, of the Bolt rotation in the first and second degree is disclosed.

Currently, the rotation or turn from fully locked (22.5 degrees) to 1 degree of unlocking takes about 0.041," on the standard Cam Path as defined in the Technical Data Package (TDP). This amount takes up about 0.325" of available space, or about 12.6% of all space to rotate the necessary 22.5 degrees to "unlock" the Bolt. And this is about 19.2% of current TDP camming surface (0.041" of current 0.013") this rotation is excessive and creates the most movement when the fired cartridge is at maximum pressure—which occurs immediately after firing.

The current disclosure further relates to using less than the aforementioned amount or about 19.2% of available camming space in unlocking the Bolt in this first degree of movement.

With the standard TDP "locked dwell" (the space provided for back and forth movement with no rotation while the Bolt is fully locked in battery) of 0.070", combined with the standard first degree of rotation (about 0.041"), an excessive amount of travel may occur for optimal use, and thus less than this space may be used for the and first degree of movement. This approach "turns" or rotates the Bolt more quickly than is currently done in the TDP dimensions and thus provides more optimized unlocking for smoother firing and operation. The first degree of rotational movement (from 22.5 to 21.5 degrees) may take less than about 0.041" of space for optimal use, regardless of any changes to the Locked Dwell that may be considered.

The second degree of rotation (from 21.5-20.5 degrees) uses about 0.014" of distance per the TDP dimensions. This amount of distance used may be left as is, or it may be decreased (more than about 0.014" of space for this degree of turn) or it may be increased in turn rate (less than about 0.014" of space for this degree of turn), as desired for particular implementations. The space saved on the first (and/or second) degree of rotation may be applied throughout the entire range of locking/unlocking to help provide maximum smoothness and reliability. This saved space may be added to the Unlocked Dwell—which is now nearly or entirely eliminated—and that space can now be used for the Camming or rotational movement of the Bolt during locking and unlocking. The remainder of the turn rate or rotation of the Bolt may be maintained as is per TDP, or it may be increased or decreased as applicable. These space savings too may be added (or not) to the Unlocked Dwell (or Unlocked Dwell) and first degree (and second, etc., as desired) of movement as described above for optimal operation. The additional space created by the near or total elimination of the Locked Dwell and the more efficient use of initial rotational movement (especially in the first but also the second degree) permit the smoothest operation possible.

The reduction in linear space taken to accommodate the first degree of rotation from fully locked (in battery) is further disclosed, as is the change in space taken to accommodate the second degree of rotation. The first degree currently takes about 0.041" beyond the Locked Dwell. The reduction in space to less than 0.041" is disclosed here. This enables the remainder of the space allotted for unlocking and locking (collectively referred to as "Camming" due to the actuation of the Cam Pin by the Cam Path and the resultant turning or rotation of the Bolt) to be used more effectively than is currently the case. The second degree of rotation, which currently takes about 0.014" of space may be left as is, or it may be increased or it may be decreased. Likewise the third degree, which takes about 0.010," may be left as is or increased or it may be decreased. Similarly the remaining rotation rate of the remaining 19.5 degrees may be changed or left alone.

The changes to the initial rotation, especially the first degree, but also the subsequent second and third degree and so on, may be combined with changes to the Locked Dwell as well as the Unlocked Dwell if so desired. Changes can be made to either Dwell, and the Cam Path may be standard sized (i.e. about 0.325" per Military Specification or Mil Spec), or it may be altered in length as described elsewhere in this application.

All changes should be considered on both an absolute (given number or measure) or relative (viewed as a percentage where any size changes are made) scale, and be considered as appropriate without limitation.

Gas Key

The use of material removal or adjustment to create a "gap"—e.g., for fouling to accumulate and reduce frictional contact, etc.—between the bottom of the Gas Key and the top most "contact" area at which the Gas Key touches the side wall of the receiver slot—is repeated here for emphasis. This approach creates many advantages covered in great detail in applications previously filed by the present inventor.

Bolt Catch—

Ambidextrous Bolt Catch is reiterated here—using an integral extension beyond the normal Bolt Catch within the receiver, or using an extension of one or more pieces that may be affixed or otherwise attached or connected through the receiver. This approach avoids problems associated with having such a device pass through the trigger guard, which trigger guard approach may create safety issues.

The Arm or extension may optimally exit at or to the rear of the magazine release button—this approach ensures optimal ergonomics and is readily learned and mastered by shooters. One advantage of this approach is that the control pad is close to but distinct from the mag release button. Additionally this ensures that the greatest amount possible of the Arm is covered by the receiver and thus protected from possible damage. Further, routing the Arm in this path ensures that the Receiver is cut at the thickest portion possible which reduces any negative impact on Receiver strength.

The Arm and pad may be contained within an area that is within the Receiver Reinforcement area (drawing an imaginary line from the outermost portion of the receiver, the Arm and Pad will fall within these points or otherwise minimally protrude from them), which may provide optimal protection to the parts and minimize the possibility of catching on clothing or other equipment.

A device that covers the entire Trigger is also disclosed—such device may be attached during non-firing times to help enhance safety. This enhanced safety occurs because the mechanical safety sometimes is switched off during routine handling of the weapon.

Bolt

Sand cuts on body of the Bolt are repeated here with additional emphasis on placement adjacent to and intersecting with back of bolt lugs—an approach that enables fouling to be pushed out during bolt rotation. The cut may be done radially around the Bolt body with some degree of the cut touching on or into the rear part of the Lugs. This approach is especially desirable at the base—but could be used otherwise on this area.

The Bolt Lugs may have the rear surface—which locks into the barrel extension—reduced or otherwise modified to decrease locking surface especially on the number 1 and 7 lugs (adjacent to the Extractor), which are normally the Lugs that break due to much, much higher forces applied to these than to other lugs. Recent studies have shown that the forces applied to these lugs may be significantly higher than that applied to the other Lugs. By reducing the contact area—particularly at the upper or outer part of the Lugs—forces may be dramatically reduced, which may promote greater part life of these lugs in particular. The area modification or reduction need not be applied to all or any of the other lugs to accommodate or allow for these particular stresses. Dual ejectors with changed rotational orientation as compared to TDP orientation using a single pin are repeated here, as are dual extractor springs, which use captive springs that are not prone to loss during disassembly. A single, larger Ejector which uses more than a single spring is also disclosed.

TEMPER—greater than called for in TDP of 350-375 F. The use of better heat treatment than currently done under TDP is disclosed. Current specifications—in use for nearly half a century—call for Carpenter 158 (C158) steel to be tempered at 350-375 F. C158 is the standard under TDP as is this tempering temperature—this approach has been used for nearly 50 years. Commercial Bolts are often made with 9310 steel which is tempered at a similar (300-350-375° F.) temperature. One problem with this approach is that when steel has an operating temperatures that exceeds its tempering temperature, the steel weakens dramatically. This weakness is not obvious until breakage occurs or at times faint cracks may be visible in close inspection. While an M4/M16 Bolt can operate in theory with sheared Lugs, a breakage at the Cam Pin hole is catastrophic. Such a breakage renders the weapon totally unserviceable. After careful study and observation, the present inventor has concluded that a driving force for this type of Bolt breakage is excess temperatures during firing. This breakage occurs because this part of the Bolt is closest to the hot gasses (2500-3000° F. when fired) used to cycle the action. These gasses are more prevalent, and hotter, during full automatic and suppressed (using a sound suppressor) fire. The Bolt becomes weak due to excessive heat exposure (>350° F.) and eventually breaks at times. Higher temperature tempering operations may reduce or eliminate this weakness that is currently found in the system.

Preferably the Tempering temperature is at least 400-500° F., more preferably it is 500-600° F., even more preferably it is 600-800° F., and most preferably it is 800-1100° F. or greater. This approach will require stronger more robust alloys than widely used C158 or 9310 but will provide many significant advantages in durability and reliability.

Alloy

The use of stronger, more robust alloys that withstand higher temperature processing than C158 or 9310 is disclosed. Specifically, even though C158 and 9310 are strong, robust materials, they suffer great losses in strength and toughness when case hardened or nitriding and otherwise exposed to high temperatures. The case hardening carried out via carburization or nitriding may significantly weaken the strength and toughness of the core. In some cases this hardening strength may fall by as much as 70-80% or more.

A more suitable range of materials are found where the Plane Strain Fracture Toughness (Kic) is above 85 K psi after suitable hardening. C158 is rated at 85 K psi but again drops off dramatically when carburized, etc., as called for by TDP. 9310 is rated similarly.

More suitable materials will have Kic of >85 k-100K psi, more preferably 100K-115K psi, and most preferably 115K-130K psi or more after suitable hardening.

Additionally, due to the impact of corrosion on Bolt breakage, the use of materials with stress corrosion cracking (SCC) capabilities greater than that found in C158 and 9310 is disclosed as optimal for Bolts in the M16 FoW.

Cam Pin

The use of a Cam Pin with a relieved portion within the "cylinder" that passes through the Cam Path is repeated, as is the reduction in side contact length (front to rear) or height (top to bottom) of the cam Pin "head". The Head is the portion that extends from the Cylinder and reciprocates within the Upper Receiver. The Head may be made wider in width (side to side) to promote more consistent Bolt travel within the receiver while firing. For emphasis, reduction of the Head height lessens drag but another advantage is that the likelihood of the Cam Pin hitting the receiver may be significantly reduced. Both of these approaches reduce parasitic drag of energy loss during recoil and counter-recoil forces, which in turn promotes greater reliability.

Action Spring

Action Springs are an Achilles Heel for the M16 FoW, especially for shorter Carbine variants. These springs often lack sufficient energy to return the Bolt fully into Battery, especially in austere conditions. The springs may also lack sufficient rebound energy and permit the shooter and weapon to be "battered" when the Buffer crashes into the rear of the Buffer Tube. In many cases, stronger rates have been tried with limited success—the gun can easily be "over sprung" and have a resulting short stroke.

Disclosed herein is an Action Spring with more than about 20-25, or preferably more than 30, coils with a wire width greater than 0.072". This approach permits the Spring to have sufficient rebound and stroke energy to promote the smoothest possible shooting. This energy will be at least 2-10% greater than found in the TDP Spring, and preferably 10-20% more, and even more preferably 20-25% or more energy. Flat wire springs may enable this effect in semiautomatic weapon use, but are unreliable in fully automatic fire due to the spring "catching" on the Buffer Tube and hindering proper operation of the gun. This feature is a critical hindrance for duty weapons used in military or law enforcement applications.

The use of flattened, or rolled, round wire with fully radiused outer edges is disclosed herein for use for this purpose. The fully radiused outer edges permit proper and reliable full automatic fire—while operating in an envelope that permits a shorter "solid height" than TDP Carbine Action Spring and providing greater "in battery" and "total" force as compared to the TDP Carbine Action Spring.

Further improvements include an Action or Buffer Spring to be used in an M4 Carbine system that uses a Solid Height (that is fully compressed, without any space between the coils) less than the current Solid Height of about 88-94% of available Buffer length is disclosed. Typical Buffers have about 3.00" of 3.25" total length available for the Spring to compress in when the gun is fired and the action is cycled.

Spring "stack" occurs when the Spring is compressed within about 90% of reach of solid height, and forces needed to further compress the spring climb abruptly or "spike."

The reduction of Spring solid height to less than about 75-87.9% is disclosed, and preferably this will be about 65-75% or less, and more preferably about 50-65% or less, and most preferably about 35-50% of available space or less. The reduction of spring solid height may help smoothen the action cycle, and also provide enhanced Spring life.

Buffer

Extending the radius on the front and back of the Cam Pin "head" (the part that is at the front and contacts the rear of the Bolt Carrier) beyond that normally found in a Carbine Buffer is repeated. This approach minimizes the contact area of the head to the Buffer Tube and enhances reliability in austere conditions.

By minimizing the Head thickness to less than TDP for the Carbine Buffer (nominal 0.250"), the Action Spring has more room to operate and more space for movement prior to reaching "solid" (or fully compressed) length—this feature is also repeated here for emphasis.

Further, decreasing the length of the Buffer "head", which is currently about 0.25" of overall 3.25" length will enable more space for the Spring to operate. This is about 92.3% of total space—thus the use of more than about 92.3-92.5% of available space for the Spring to operate in is disclosed. Ideally this will be about 92.6-95% or more of total length with a Buffer designed to operate in a Carbine length system—which is designed around the current M4 Carbine used by the US military and many law enforcement organizations and many sport shooters.

Charging Handle—

The use of flutes, sand cuts, or an otherwise relieved outer contact surface of the Charging Handle to minimize frictional contact and provide a place for fouling to harmlessly accumulate is repeated here. So too is the movement forward to the "tabs" that guide the Charging Handle (CH) within the Upper Receiver—this approach permits additional stroke or travel to be gained in the Bolt Carrier without the possibility of the CH falling out of the slots and hindering proper function of the gun.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

It is understood that the specific order or hierarchy of the processes/flowcharts disclosed is an illustration of example approaches. Based upon design preferences, it is understood that the specific order or hierarchy in the processes/flowcharts may be rearranged. Further, some features/steps may be combined or omitted. The accompanying method claims present elements of the various features/steps in a sample order, and are not meant to be limited to the specific order or hierarchy presented.

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

What is claimed:

1. An assembly for a firearm, the assembly comprising:

a cam pin;

a bolt carrier with a cam slot, wherein the cam slot movably constrains the cam pin, and wherein the bolt carrier is configured to slideably engage with a bolt along a first axis; and a bolt operatively connected to the cam pin, wherein the cam pin and the cam slot at least partially constrain a rotational and linear movement of the bolt with relation to the bolt carrier, the cam slot comprising:

a first portion for constraining linear and rotational motion of the cam pin and the bolt wherein the first portion of the cam slot allows the cam pin to travel less than 0.070 inches along a second axis that is substantially parallel with the first axis;

a second portion for constraining linear and rotational movement of the bolt while guiding the cam pin along the cam slot, wherein the second portion of the cam slot is dimensioned to constrain cam pin travel to not greater than 0.0020 inches along a third axis that is substantially parallel with the first axis and the second axis; and a third portion for controlling the linear and rotational motion of the bolt.

2. The assembly of claim 1, wherein when the cam pin is in the second portion of the cam slot, a distance from the first end of the bolt carrier and a center of the cam pin along a fourth axis that is parallel to the first axis is between 0.608 inches and 0.640 inches.

3. A bolt carrier for a firearm having a first end and configured to slideably engage with a bolt along a first axis, the bolt carrier further comprising:

a cam slot for movably constraining a cam pin, wherein the cam pin and cam slot are configured to partially constrain a rotational and linear movement of the bolt with relation to the bolt carrier, the cam slot comprising:

a first portion for constraining linear and rotational motion of the cam pin and the bolt wherein the first portion of the cam slot allows the cam pin to travel less than 0.070 inches along a second axis that is substantially parallel with the first axis;

a second portion for constraining linear and rotational movement of the bolt while guiding the cam pin along the cam slot, wherein the second portion of the cam slot is dimensioned to constrain cam pin travel to not greater than 0.0020 inches along a third axis that is substantially parallel with the first axis and the second axis; and a third portion for controlling the linear and rotational motion of the bolt.

4. The bolt carrier of claim 3, wherein the cam slot is dimensioned so that when the cam pin is in the second portion of the cam slot, a distance from the first end of the bolt carrier and a center of the cam pin along a fourth axis that is perpendicular to the first axis is between 0.608 inches and 0.640 inches.

5. A firearm comprising:

a cam pin a bolt carrier with a cam slot, wherein the cam slot movably constrains the cam pin, and wherein the bolt carrier is configured to slideably engage with a bolt long a first axis; and a bolt operatively connected to a cam pin, wherein the cam pin and the cam slot at least partially constrain a rotational and linear movement of the bolt with relation to the bolt carrier, the cam slot comprising:

a first portion for constraining linear and rotational motion of the cam pin and the bolt wherein the first portion of the cam slot allows the cam pin to travel less than 0.070 inches along a second axis that is substantially parallel with the first axis;

a second portion for constraining linear and rotational movement of the bolt while guiding the cam pin along the cam slot, wherein the second portion of the cam slot is dimensioned to constrain cam pin travel to not greater than 0.0020 inches along a third axis that is substantially parallel with the first axis and the second axis; and a third portion for controlling the linear and rotational motion of the bolt.

6. The firearm of claim 5, wherein when the cam pin is in the second portion of the cam slot, a distance from the first end of the bolt carrier and a center of the cam pin along a fourth axis that is parallel to the first axis is between 0.608 inches and 0.640 inches.

7. The assembly of claim 1, wherein in the second portion of the cam slot, the cam pin travels a distance greater than 0.0000 inches along the third axis.

8. The bolt carrier of claim 3, wherein in the second portion of the cam slot, the cam pin travels a distance greater than 0.0000 inches along the third axis.

9. The firearm of claim 5, wherein in the second portion of the cam slot, the cam pin travels a distance greater than 0.0000 inches along the third axis.

* * * * *